United States Patent [19]

Iwata

[11] Patent Number: 4,591,668

[45] Date of Patent: May 27, 1986

[54] VIBRATION-DETECTING TYPE MICROPHONE

[75] Inventor: Keisuke Iwata, Tokyo, Japan

[73] Assignee: Iwata Electric Co., Ltd., Tokyo, Japan

[21] Appl. No.: 622,654

[22] Filed: Jun. 20, 1984

[30] Foreign Application Priority Data

May 8, 1984 [JP] Japan ..... 59-66748[U]
May 8, 1984 [JP] Japan ..... 59-66749[U]

[51] Int. Cl.[4] ..... H04R 17/02; H04R 7/26

[52] U.S. Cl. ..... 179/121 C; 179/110 A; 179/181 R

[58] Field of Search ..... 179/121 C, 110 A, 181 R; 381/67, 114; 455/89

[56] References Cited

U.S. PATENT DOCUMENTS

| | | | |
|---|---|---|---|
| 2,121,779 | 6/1938 | Ballantine | 179/121 C |
| 3,239,696 | 3/1966 | Burkhalter et al. | 179/121 C |
| 3,858,005 | 12/1974 | Marshall et al. | 381/67 |
| 3,868,954 | 3/1975 | Ueda | 179/121 C |
| 4,012,604 | 3/1977 | Speidel | 179/121 C |
| 4,056,742 | 11/1977 | Tibbetts | 179/110 A |
| 4,150,262 | 4/1979 | Ono | 179/121 C |

FOREIGN PATENT DOCUMENTS 2606579 9/1976 Fed. Rep. of Germany ... 179/110 A

*Primary Examiner*—Gene Z. Rubinson
*Assistant Examiner*—Danita R. Byrd
*Attorney, Agent, or Firm*—Robert E. Burns; Emmanuel J. Lobato; Bruce L. Adams

[57] ABSTRACT

A vibration-detecting-type microphone for detecting voice vibrations by being contacted to the buccal region or the mastoid of the temporal region of a user. This microphone has a belt-like diaphragm whose both ends are fixed to a casing with one end open, a piezoelectric element installed on the rear central part of this diaphragm, and a vibration pickup situated on the external surface of this diaphragm and designed to be contacted with the human body. The rear surface of the vibration pickup has at least one pair of sensing elements, and these sensing elements are located in such a way that they will not oppose the piezoelectric element through the diaphragm. This arrangement makes it possible to select and set the resonance frequency of the diaphragm and microphone, as desired. In addition, since the sensing elements of the vibration pickup are supported at two points or more by the diaphragm, the concentration of stress into the diaphragm as well as the damaging of the piezoelectric element can be prevented.

12 Claims, 7 Drawing Figures

VIBRATION-DETECTING TYPE MICROPHONE

BACKGROUND OF THE INVENTION

The present invention relates to a vibration-detecting-type microphone that detects voice vibrations and converts them into voice signals by contacting the microphone with the buccal region or the mastoid of the temporal region of a user, and more particularly, to a vibration-detecting-type microphone that makes it possible to establish a desired resonance frequency of a diaphragm for detecting voice vibrations in the buccal region or the mastoid of the temporal region of the user.

Hand-free voice-controlling-type transceivers are used widely at construction sites and workplaces, in group activities at school and other similar occasions when a plurality of people in distant positions engage in conversation. Also, in the case of learning equipment, in cases where a teacher and specific learners engage in conversation through a master equipment and subsidiary equipment, transmitting and receiving apparatus with a speaker and a microphone installed on a headband are used. In such a transmitting and receiving apparatus, however, not only voice sounds uttered from the mouth of a user but also all sorts of acoustic noises generated in the external environment, e.g., noises from a construction machine, are inputted. In consequence, the person who receives and listens to the inputted voice sounds is bound to listen to voice sounds with such noises mixed in, which are difficult to listen to. For this reason, in workplaces where an industrial machine or a civil engineering machine, for example, is being operated, such transmitting and receiving apparatus disadvantageously failed to function effectively in carrying out conversation in operational activities or the like.

DESCRIPTION OF THE PRIOR ART

To obviate the aforementioned defects, a so-called bone-conductive-type microphone which detects voice vibrations in the external auditory canal that are transmitted from the mouth to the bone structure in the head was recently developed. Such a bone-conductive type microphone is disclosed in the U.S. Pat. No. 4,150,262. This bone-conductive type microphone is composed of a casing having an an earpiece means adapted to be inserted in the external auditory canal of a user, a supporting member fixed in the casing, a piezoelectric element one end of which is fixed to the supporting member and the other end of which is located in the earpiece means, and a lead wire leading out the output voltage of the piezoelectric element. This arrangement makes it possible to transmit to the piezoelectric element vibrations generated in the external auditory canal when voice sounds are uttered, and to obtain an output voltage from the piezoelectric element via the lead wire according to the distortion generated in accompaniment with these vibrations. This voltage is reproduced as voice sounds through an amplifier and the like, and after making the necessary correction of the sound quality, the voice signals are outputted from a speaker, enabling the listener to listen to the voice sounds. Accordingly, it is possible to listen to only clear voice sounds since external noises are not inputted to the microphone together with the voice signals. When a headphone is applied to the other ear, however, both ears are blocked since such a microphone is inserted into the external auditory canal. Accordingly, when such a microphone is used at a construction site or the like, it is extremely dangerous since an alarm from the outside or the sound of a moving machine or the like does not directly reach the ear of the user.

For this reason, the inventor, earlier in the U.S. application No. 556,078 filed on Nov. 29, 1983, proposed a bone-conductive type microphone contacting the temporal region in the rear of an ear. This bone-conductive type microphone has a cover plate which is brought into contact with the temporal region, a diaphragm securing the cover plate, and a piezoelectric element adhered to the diaphragm. By means of the diaphragm, the microphone picks up voice vibrations transmitted to the temporal region. When this microphone is used for a transmitting and receiving apparatus combined with a headphone, it is possible to effect wireless communication or conversation without blocking both ears. Accordingly, it has become possible to effect communication without interference of noise from the sending side's environment, and to permit listening to voice sounds having a high clarity. Looking at this microphone structurally, however, the projection of a cover plate comes into contact with the central part of the diaphragm with its periphery fixed, and a piezoelectric element is installed on the rear side of the diaphragm of this contacting part. For this reason, audio propagation characteristics and audio frequency characteristics that are determined by the material quality, weight, etc. of the diaphragm and the casing securing the periphery of the diaphragm are deteriorated substantially in the low and high frequency bands. Therefore, there is a problem in that when there is an effect from the external noise, the voice sounds inevitably become unclear owing to a drop in the SN ratio. Furthermore, when a design change is made as to the material quality and the weight of the casing, and if a diaphragm prior to the design change is used, there is a problem in that the frequency characteristics of the audio propagation change. To improve the frequency characteristics of audio propagation in a low frequency band and a high frequency band, it suffices to make the effective length of the diaphragm longer. In this case, however, the shape of a microphone becomes large, and it becomes impossible to have a form and shape suited to contact the temporal region or the like.

Furthermore, since the projection of a cover plate is installed in the central part of a diaphragm, there is a defect in that if external force is applied to the cover plate, the stress concentrates into the central part of the diaphragm, with the result that the central part is given a large bend, thereby breaking the piezoelectric element installed on the rear surface.

SUMMARY OF THE INVENTION

Accordingly, a primary object of the present invention is to provide a vibration-detecting-type microphone capable of establishing a desired and sufficient effective length of a diaphragm and improve the frequency characteristics of voice propagation at low and high frequency bands, and thereby to effect the propagation of clear voice sounds with reduced noise.

Another object of the invention is to provide a vibration-detecting-type microphone wherein any external force acting on the vibration pickup contacing the human body is dispersed efficiently, and, at the same time, the external force is not directly applied to a piezoelectric element.

A further object of the invention is to provide a buccal region-contacting-type microphone adapted to contact the buccal region of the human body and detect voice sounds by means of the vibration of the buccal region.

According to the present invention, there is provided a vibration-detecting-type microphone comprising: a casing one end of which is open; a flexible diaphragm both ends of which are secured at the opening of the casing, and which extends in a zigzag form on the same plane within the opening; a piezoelectric element installed on the inner surface of the diaphragm; and a vibration pickup designed to contact the human body and located on the external surface of the diaphragm, and having, on the internal surface thereof, at least one pair of feeler elements contacting the diaphragm at a position that does not oppose the piezoelectric element through the diaphragm.

In a preferred embodiment of the present invention, the flexible diaphragm is formed substantially in an inverted S shape, the piezoelectric element is installed on the internal surface of this diaphragm in the intermediate part in the longitudinal direction, and the feeler projections of the vibration pickup are installed in such a manner as to straddle the piezoelectric element. Furthermore, the casing is covered with an elastic cover means made of rubber or synthetic resin.

Since the diaphragm of the vibration-detecting-type microphone of the invention has a zigzag shape, it is possible to secure a sufficient effective length within the limited open area of the casing. Accordingly, it is possible to select and establish the flexible diaphragm and the resonance frequency of the microphone, as desired, thereby permitting transmission and reproduction of clear voice sounds without being affected by noises from the outside. Since the flexible diaphragm occupies a small space, it is possible to provide a microphone having dimensions and a shape suited to the buccal region and the mastoid of the temporal region of the human body.

Furthermore, since the feeler projections of the vibration pickup are secured at two points or more against the flexible diaphragm, it is possible to efficiently disperse the external force acting on the diaphragm, and to prevent the concentration of stress with respect to the diaphragm, thereby avoiding a local bending of the diaphragm. For this reason, breakage of the piezoelectric element as a result of the bending can be prevented. Since these feeler projections are not installed in a position that directly transmits the external force onto the piezoelectric element, the impact exerted on the feeler projections does not directly damage or break the piezoelectric element.

DESCRIPTION OF THE PREFERRED EMBODIMENT

Figure 1:
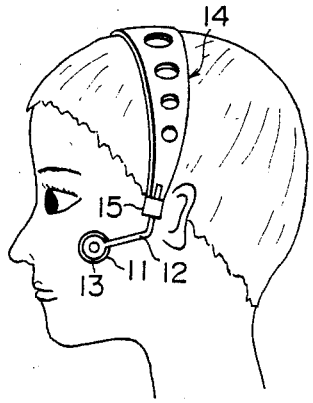
FIG. 1 illustrates the state of using the vibration-detecting-type microphone of the invention according to one embodiment.

Referring to FIG. 1, the vibration-detecting-type microphone of the present invention is generally denoted by a reference numeral 11. This microphone 11 is installed on a microphone-supporting board 13 provided at one end of an arm 12 bent substantially in an inverted L shape. The other end of the arm 12 is adjustably installed on a supporting member 15 which, in turn, is installed on one end of a headband 14. The supporting member 15 is of the type that has a screw for fixing itself in a desired position to the arm penetrating therethrough, or of the type that is composed of a synthetic resin with a large coefficient of friction and that fixes the arm in a desired position by means of friction. The supporting member 15 serves to adjust the microphone 11 to lightly pressure-contact the buccal region of a user. At the other end of the headband 14, a headphone, though not shown, is installed, which is used to listen to the voice of the other person.

Figure 2:
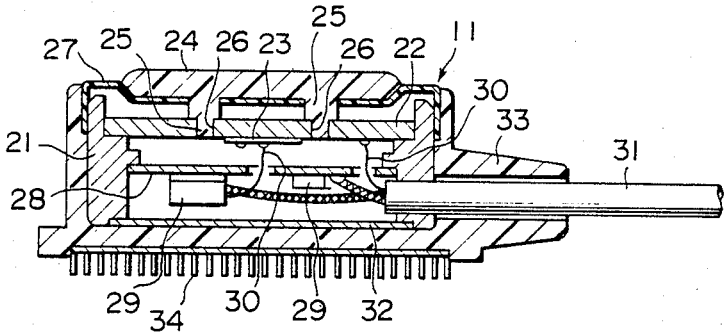
FIG. 2 is a longitudinal cross section of the microphone shown in FIG. 1.
Figure 3:
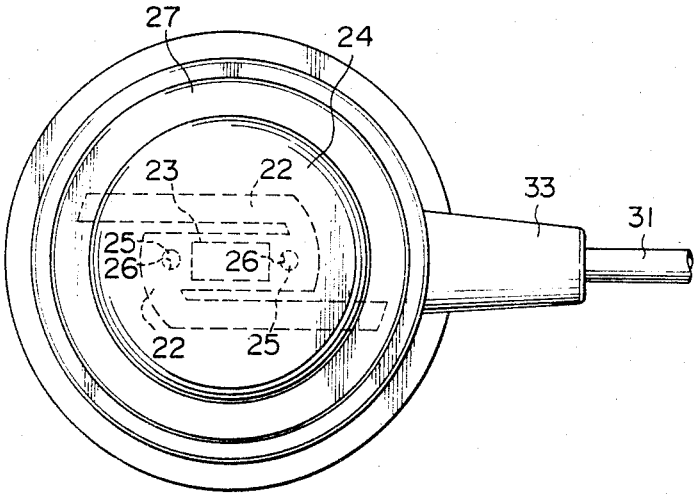
FIG. 3 is a plan view of the microphone shown in FIG. 1.
Figure 4A:
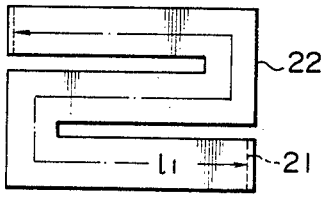
FIG. 4*a* is a plan view showing a diaphragm of the microphone shown in FIG. 2.

One embodiment of the microphone 11 of the present invention is hereinafter described in detail, while referring to FIGS. 2 and 3. The microphone 11 has a cylindrical casing 21 having high rigidity and formed by the molding of a synthetic resin or metal. Both ends of a flexible and belt-like diaphragm 22 are held and secured at the other open end of the casing 21. As a means to hold and secure these ends, a desired means is used selectively from among the means of fitting, adhesion, and tightening with a tightening member. The flexible diaphragm 22 is shaped in a zigzag form, and, in this embodiment, has a winding shape, i.e., a substantially inverted S shape, as shown in FIG. 4*a*. The flexible diaphragm 22 is formed by punching a metal sheet having a high vibration transmission sensitivity. As shown in FIG. 2, a piezoelectric element 23 is attached onto the central part of the rear or inner surface of the diaphragm 22.

As shown in FIG. 2, a vibration pickup 24, one entire surface of which contacts the buccal region or the mastoid of the temporal region of the user, is located on the upper surface of the diaphragm 22. On the other surface of this vibration pickup 24 are provided two feeler projections or elements 25 that protrude a fixed distance toward the diaphragm 22. These feeler projections 25 penetrate and are fixed by an installation hole 26 provided in the central part of the diaphragm 22. In other words, the vibration pickup 24 is supported at two points by the diaphragm 22. As shown in FIG. 2, the piezoelectric element 23 is located between the feeler projections 25 at a location between imaginary lines which extend through the feeler elements in a direction perpendicular to the diaphragm 22. A flexible cover 27 made of rubber or synthetic resin is located at the other surface of the vibration pickup 24. This cover 27 is designed to seal one open end of the casing 21 and prevent sweat or rain drops from entering the casing 21. The peripheral side of the cover 27 is fitted onto the peripheral surface of the casing 21.

An electronic circuit board 28 is installed at the central part of the casing 21, spaced from the diaphragm 22. The electronic circuit board 28 contains electronic circuit parts 29 such as a resistor and an impedance transforming element to obtain an output voltage in correspondence with the distortion generated in conjunction with the vibration of the diaphragm 22. These electronic circuit parts 29 are connected to the piezoelectric element 23 via a lead wire 30. The signal voltage from the electronic circuit parts 29, after undergoing impedance transformation, is led outside by means of an external lead wire 31.

The other open end of the casing 21 is closed by a rigid cover plate 32. The plate 32 prevents the electronic circuit parts 29 and the piezoelectric element from being directly subjected to any external mechanical force and being damaged as a result. All the peripheral surfaces of the casing 21, with the exception of one open end, the external side surfaces of the cover plate 32, and the vicinity of the portion of the external lead wire 31 installed onto the casing are coated with an elastic cover 33 made of rubber or synthetic resin. Because of the cover 33, the vibration of the headband 14 and the external lead wire 31, as well as the noise of hair and clothes contacting the headband 14 and the external lead wire 31, or windbreaking sound, are prevented from being propagated into the casing. A fastener member 34 composed of a multiplicity of rigid, implanted hairs is fixed to the outer surface of the cover 33. The fastener member 34 is detachably engaged with a fastener member (not shown) composed of soft, implanted hairs provided on the rear surface of the microphone-supporting board 13.

Next, description is made of the operation of the microphone 11. When using the microphone by bringing it into contact with the buccal region of the user, as shown in FIG. 1, the vibration of air generated inside the throat and the oral cavity is directly transmitted to the cheek. As a result, The vibration thus transmitted is immediately transmitted to the vibration pickup 24 that contacts the outside surface of the buccal region. The vibration of the vibration pickup 24 is transmitted to the flexible diaphragm 22 via the feeler projections 25. Since the diaphragm 22 is provided with the piezoelectric element 23, the piezoelectric element 23 is subjected to this vibration, and an output voltage is generated between the piezoelectric element 23 and the diaphragm 22. After transforming the impedance of the output voltage by means of the electronic circuit parts 29, the output voltage is taken out via the external lead 31 and is transmitted after subjecting it to necessary processing.

Figure 4B:
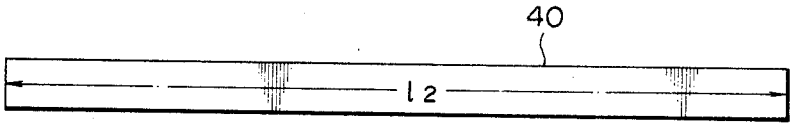
FIG. 4*b* is a plan view showing a linear diaphragm.

The length of the flexible diaphragm 22, i.e., the length $l_1$ of the dash and dotted line shown in FIG. 4*a*, becomes the portion contributing to the propagation of vibration. The resonance frequency f of the diaphragm can be obtained by the formula:

$$f = \frac{\alpha}{2\sqrt{3}} \cdot \frac{t}{l^2} \sqrt{\frac{E}{\rho}} \Big/ 2\pi$$

Where $\alpha$ is a reference constant; l is the length of the diaphragm; t is the thickness of the diaphragm; E is the Young's modulus; $\rho$ is the density of the material;

$$\sqrt{\frac{E}{\rho}}$$

is the vibration propagation speed (m/sec). Accordingly, the resonance frequency f is affected substantially by the length of the diaphragm 22, in addition to its material and thickness. The length $l_1$ of the diaphragm 22 in this embodiment is virtually equivalent to the length $l_2$ of the diaphragm 40 shown in FIG. 4*b*. Therefore, it is possible to obtain the resonance frequency equivalent to the resonance frequency of the linear diaphragm 40. In other words, even though the diaphragm 22 is formed in a reverse S shape as shown in FIG. 3, it is possible to obtain the resonance frequency corresponding to its overall length.

Therefore, when an attempt is made to emphasize the voice sounds of a specified frequency band alone by selecting a desired resonance frequency band, or when an attempt is made to eliminate the noise of a specified frequency band, the selection of such a resonance frequency band can be facilitated by selecting an overall length of the diaphragm 22. Furthermore, when it is necessary to make the overall length of the diaphragm 22 larger, it is possible to do so without enlarging the occupying space by connecting a plurality of reverse S-shape diaphragms, i.e., by forming a waveform. As a result, it is possible to construct a vibration-detecting-type microphone with a shape and size conveniently adapted to contact the buccal region and the mastoid of the temporal region.

Figure 5A:
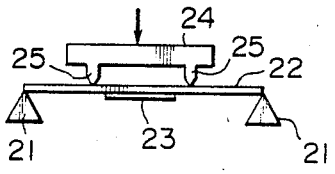
FIG. 5*a* is an explanatory drawing showing the relationship of contact between a vibration pickup and diaphragm as well as a piezoelectric element.
Figure 5B:
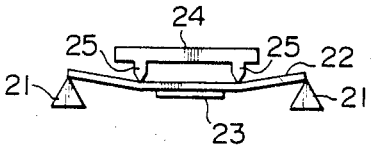
FIG. 5*b* is an explanatory drawing showing a case where a strong external force has been applied to the vibration pickup in FIG. 5*a*.

As shown in FIG. 5*a*, some external force or the like may act on the vibration pickup 24, with the result that the feeler projections 25 may transmit impact upon the flexible diaphragm 22. In this case, since, in the present invention, the feeler projections 25 are installed in such a way that they straddle the piezoelectric element, the portion of the diaphragm 22 that undergoes deformation is its peripheral portion, excluding the installing surface of the piezoelectric element 23. Accordingly, such a force does not directly act on the piezoelectric element 23 per se. In addition, since the stress is dispersed the two points and their surrounding parts, it is possible to alleviate the concentration of such stress as found in the conventional case of a one-point support, and it is also possible to protect the flexible diaphragm 22.

What is claimed is:

1. A vibration detecting microphone comprising:

a casing having one open end defining an opening;

a flexible diaphragm extending in a zigzag form and lying in a plane within the opening, the diaphragm having two ends secured at the opening;

a vibration pickup configured to contact the human body during use of the microphone and located on an external side of the diaphragm at a given distance therefrom, the pickup having at least one pair of spaced-apart feeler elements contacting the diaphragm; and a piezoelectric element mounted on the diaphragm, the piezoelectric element being positioned between and out of contact with the feeler elements.

2. A vibration detecting microphone according to claim 1, the diaphragm being formed substantially in an inverted S shape.

3. A vibration detecting microphone according to claim 1, the piezoelectric element being located on an inner surface of the diaphragm opposite to the external side thereof.

4. A vibration detecting microphone according to claim 1, the piezoelectric element being mounted on an intermediate portion in a longitudinal direction of the diaphragm, and the intermediate portion of the diaphragm being located substantially in an axially central part of the casing.

5. A vibration detecting microphone according to claim 1, further comprising:

a flexible cover member covering the opening of the casing at a predetermined distance from the diaphragm, the peripheral end of the cover member being fixed to the casing.

6. A vibration detecting microphone according to claim 1, further comprising:

an elastic cover made of rubber or synthetic resin covering the outer periphery of the casing, excluding the opening of the casing.

7. A vibration detecting microphone according to claim 6, wherein an external bottom surface of the elastic cover member is provided with a fastener member for mounting a microphone supporting member.

8. A vibration detecting microphone comprising:

a casing having an open end; a flexible diaphragm mounted in the open end of the casing, the diaphragm having opposed inner and outer sides and comprising a sheet-like member having a generally zigzag shape; a vibration pickup configured to contact the human body during use of the microphone and disposed on the outer side of the diaphragm, the pickup having a pair of spaced-apart feeler elements extending toward and contacting the diaphragm; and a piezoelectric element mounted on the diaphragm, the piezoelectric element being positioned on the diaphragm at a location between imaginary lines extending through the feeler elements in a direction perpendicular to the diaphragm.

9. A vibration detecting microphone according to claim 8; wherein the zigzag shape of the diaphragm comprises a generally inverted S shape.

10. A vibration detecting microphone according to claim 8, wherein the piezoelectric element is mounted on the inner side of the diaphragm.

11. A vibration detecting microphone according to claim 8, wherein the piezoelectric element is spaced from and out of contact with the feeler elements.

12. A vibration detecting microphone according to claim 8, wherein the piezoelectric element is positioned at the geometric center of the diaphragm.

* * * * *